US008406916B2

(12) United States Patent
Bentele et al.

(10) Patent No.: US 8,406,916 B2
(45) Date of Patent: Mar. 26, 2013

(54) SYSTEM FOR INDIVIDUALIZED FILLING OF BLISTERS OF BLISTER PACKS

(75) Inventors: Josef Bentele, Laupheim (DE); Georg Pfau, Laupheim (DE)

(73) Assignee: Uhlmann Pac-Systeme GmbH & Co KG, Laupheim (DE)

( * ) Notice: Subject to any disclaimer, the term of this patent is extended or adjusted under 35 U.S.C. 154(b) by 1022 days.

(21) Appl. No.: 12/275,266

(22) Filed: Nov. 21, 2008

(65) Prior Publication Data

US 2009/0133362 A1 May 28, 2009

(30) Foreign Application Priority Data

Nov. 24, 2007 (EP) ..... 07022807

(51) Int. Cl.
*B65B 57/00* (2006.01)

(52) U.S. Cl. ..... 700/216; 53/246; 53/453; 53/475; 53/53; 53/558; 53/559; 53/76; 104/28; 141/94

(58) Field of Classification Search ..... 700/214–216, 700/219–222; 53/115
See application file for complete search history.

(56) References Cited

U.S. PATENT DOCUMENTS

| | | | | |
|---|---|---|---|---|
| 4,552,262 | A * | 11/1985 | Murakami et al. | 198/447 |
| 5,155,981 | A * | 10/1992 | Tordini | 53/559 |
| 5,383,322 | A * | 1/1995 | Collins et al. | 53/53 |
| 5,442,892 | A * | 8/1995 | Burns et al. | 53/53 |
| 5,799,468 | A * | 9/1998 | Eck et al. | 53/453 |
| 5,852,590 | A * | 12/1998 | de la Huerga | 368/10 |
| 6,115,990 | A * | 9/2000 | Vogelsanger | 53/53 |
| 6,208,908 | B1 * | 3/2001 | Boyd et al. | 700/216 |
| 6,470,650 | B1 * | 10/2002 | Lohwasser | 53/453 |
| 7,225,597 | B1 | 6/2007 | Knoth | 53/246 |
| RE40,510 | E * | 9/2008 | Lasher et al. | 53/55 |
| 7,856,794 | B2 * | 12/2010 | Zieher | 53/246 |
| 7,933,780 | B2 * | 4/2011 | De La Huerga | 705/2 |
| 2002/0007867 | A1 * | 1/2002 | Takada et al. | 141/94 |
| 2003/0074868 | A1 * | 4/2003 | Yasuoka et al. | 53/493 |
| 2003/0188509 | A1 * | 10/2003 | Lagerstedt | 53/53 |
| 2004/0158350 | A1 * | 8/2004 | Ostergaard et al. | 700/231 |
| 2004/0226262 | A1 * | 11/2004 | Salvoni | 53/76 |
| 2005/0217208 | A1 | 10/2005 | Cicognani | 53/54 |

(Continued)

FOREIGN PATENT DOCUMENTS

| | | |
|---|---|---|
| DE | 4208818 | 9/1993 |
| FR | 2754239 | 4/1998 |

(Continued)

*Primary Examiner* — Gene Crawford
*Assistant Examiner* — Kyle Logan
(74) *Attorney, Agent, or Firm* — Andrew Wilford

(57) ABSTRACT

Blister packs each having a plurality of pockets with individualized assortments of small objects are filled by fitting to each of a plurality of shuttles a respective such blister pack and circulating the shuttles around an annular track through a plurality of filling machines. Each machine has a plurality of supplies each holding a bulk quantity of small objects of a respective type, respective feeders each receiving the objects of a respective supply and advancing same one at a time to a respective picking location, and respective pickers. A memory of each shuttle is programmed with data regarding the intended contents of the pockets of the respective blister pack, and in each of the machines, the memories of the shuttles are read as they pass through the respective filling machine. The respective pickers are operated to move small objects from the feeders to the pockets in accordance with the data for the respective blister pack.

4 Claims, 4 Drawing Sheets

U.S. PATENT DOCUMENTS

2007/0084150 A1* 4/2007 Siegel et al. ..... 53/475
2007/0137513 A1* 6/2007 Lowson et al. ..... 104/28
2007/0271882 A1* 11/2007 Litke et al. ..... 53/558
2008/0010954 A1* 1/2008 Maria et al. ..... 53/540
2008/0149657 A1* 6/2008 Kim ..... 221/2
2008/0190076 A1 8/2008 Klingel et al. ..... 53/493
2008/0223001 A1* 9/2008 Monti ..... 53/246
2008/0318750 A1* 12/2008 Combrink ..... 493/182
2009/0120042 A1* 5/2009 Zieher ..... 53/467
2009/0179644 A1* 7/2009 Bons et al. ..... 324/315

FOREIGN PATENT DOCUMENTS

WO WO-0174666 10/2001
WO WO 2006128443 A1 * 12/2006

* cited by examiner

SYSTEM FOR INDIVIDUALIZED FILLING OF BLISTERS OF BLISTER PACKS

FIELD OF THE INVENTION

The present invention relates to blister packs. More particularly this invention concerns a system for individualized filling of the blisters thereof.

BACKGROUND OF THE INVENTION

A standardized blister pack, for instance for marketing pills, capsules, and like small objects, is made by forming a thermoplastic base foil with an array of upwardly open pockets or blisters. The objects are then loaded into the pockets, either one per pocket or a predetermined number per pocket, and a top foil is bonded to the top face of the base foil between the pockets thereof, hermetically sealing in the objects. The laminated-together foils are then cut into individual packages normally each with a plurality of the pockets, and these packages are then labeled and packed for distribution. Such machines are known from German patent documents 42 08 818. They may even be set up as described in U.S. Pat. No. 7,225,597 or French 2,754,239 for putting different pills into the pockets or blisters.

A method is also known method for individually filling blister packs having pockets with small objects from a selection of at least two different small object types, in which method in one filling machine the small objects are provided in a number of supply cassettes equal to the number of small object types and are conveyed from the supply cassettes to a picking station allocated to the respective supply cassette. Here as described in WO 2001/074666 or US 2008/109007 the blister pack is supplied to the filling machine, and the small objects are transferred individually from the dispensing position by feeders such as known from US 2005/0217208 into the pockets of the blister.

For most efficient use of a complex thermoshaping machine very large numbers of identical blister packs need to be produced. However, there is also the need to be able to produce single, individually filled blister pack in order to be able to provide customers, especially patients, blister pack in which individual daily, weekly, or monthly blister pack are provided with the appropriate rations in order to prevent medication errors, especially when a plurality of medications must be taken on varying schedules.

OBJECTS OF THE INVENTION

It is therefore an object of the present invention to provide an improved system for individualized filling of blisters of blister packs.

Another object is the provision of such an improved system for individualized filling of blisters of blister packs that overcomes the above-given disadvantages, in particular that makes it possible to fill such individual blister pack in an economically efficient manner.

SUMMARY OF THE INVENTION

Blister packs each having a plurality of pockets with individualized assortments of small objects are filled by fitting to each of a plurality of shuttles a respective such blister pack and circulating the shuttles around an annular track through a plurality of filling machines. Each machine has a plurality of supplies each holding a bulk quantity of small objects of a respective type, respective feeders each receiving the objects of a respective supply and advancing same one at a time to a respective picking location, and respective pickers. A memory of each shuttle is programmed with data regarding the intended contents of the pockets of the respective blister pack, and in each of the machines, the memories of the shuttles are read as they pass through the respective filling machine. The respective pickers are operated to move small objects from the feeders to the pockets in accordance with the data for the respective blister pack.

More generically, the method of this invention is distinguished in that for economically efficient operation not only must a minimum number of identical blister pack be filled, but also it is possible to individually fill each single blister pack in an economically efficient manner, specifically with respect to a number of different small object types, to individually fill being construed to mean that each pocket can be intentionally filled with one or even a plurality of small objects of one small object type or a plurality of small objects of different small object types. It should be stressed that no small object-related format parts are required for a format change so there are no set-up times, either.

For preventing errors and for performing the method more precisely it is useful that the blister pack be stopped in the filling machine for the transfer of the small objects and the small objects are transferred between the dispensing position and the location of the pocket resulting from the position of the blister. In order to attain the sought maximum variability, it is furthermore provided within the framework of the invention that the small objects are individually picked and transferred by means of a picker system. It is particularly preferred within the framework of the invention when the blister pack is positioned on a shuttle that is guided through the filling machine because in this manner it is possible to better localize the blister pack that has already been punched from the film composite.

Moreover, it is very particularly preferred within the framework of the invention when, once the blister pack has been allocated, the data necessary for the individual filling are transmitted to the shuttle, which has a memory unit and a unit for bidirectional data traffic, and are forwarded from the shuttle to the picker system and, where required, a control system, because this assures that each blister pack transported by the shuttle is filled by the picker system with exactly the small objects of the small object types that are necessary for individually filling it, depending on the patient data.

The method attains high capacity while ensuring that the blister pack have been filled correctly in that the shuttle is guided on a closed annular track through the filling machine, to which a second control system is allocated for checking that the filled blister pack is complete and/or contains the correct contents, and in that if an error is detected by the second control system the blister pack is removed from the shuttle and the shuttle is guided back through the filling machine with a new blister pack and the unchanged, stored data. Naturally it is possible that, if the second control system determines that the blister pack has been filled correctly, the stored data are deleted from the memory unit of the shuttle and are replaced with new data that represent the information required for individually filling another blister pack.

The part of the object that concerns the device is attained using a filling machine for individually filling blister pack that have at least one pocket with small objects from a selection of at least two different small object types, a number of supply cassettes equaling the number of small object types being adjustable, from which small object types the small objects can be conveyed to a feeder providing a dispensing position and from there by means of a picker system into the pocket of the blister pack that can be transported on a conveyor system into the filling machine and out of the filling machine. Using supply cassettes makes possible great variability in the filling machine, because rapid small object change is possible by exchanging supply cassettes, wherein the dispensing position is not changed and thus the operation of the picker system does not have to be adapted to the changed palette of the small object types.

In terms of structural simplicity, it has proved useful when the feeder is formed by a vibrating trough or a conveyor belt.

For interaction with the picker system the feeder is preferably provided in upstream and downstream parts, relative to the movement of flow from the supply to the picking location, to convey the small objects more rapidly because this separates the small objects and the picker system can simply pick up the separated small objects without disturbing small objects in the near vicinity. In addition, the two-part arrangement of the feeder makes it possible for the two feeders to be arranged spaced apart from one another, forming a gap, below which gap is arranged a waste collector so that small object particles and dust can be removed. Incorrect small objects are also removed in that a waste chute leads from the downstream ends of the feeders below the gap to the waste collector.

For increasing the capacity of the filling machine and the range when picking up the small objects it is possible for a plurality of picker systems to be provided in each filling machine.

For quality control, a camera system is allocated to the feeder for locating the small objects and/or for checking their integrity and/or their ingredients and/or the light curtain and/or the NIR system, such localization also supporting operation of the picker system. It is very particularly preferred in the framework of the invention when means are provided for exchanging data between the camera system and the feeder and/or the picker system and/or the light curtain and/or the NIR system. Using this exchange of data it is possible to tell the feeder which small objects it must supply, which can be verified by the camera system, so that given appropriate verification the picker system picks up exactly the small objects that are required according to the individual filling plan.

Another preferred embodiment of the invention is characterized in that a transport system having a closed annular track is provided for at least one shuttle that accommodates the blister. For one thing, this configuration stabilizes the somewhat flexible blister pack that is punched out of the film composite and deliberately guides it through the filling machine, a limited number of shuttles being required due to the closed annular track, since in principle the shuttles can travel around the annular track continuously, a loading station for reloading empty blister pack that are to be filled and a first unloading station for unloading correctly filled blister pack is provided on the annular track. A second unloading station can be provided for separating or culling out blister pack that have been incorrectly filled.

Moreover, it is preferred within the framework of the invention when a plurality of filling machines is provided and the plurality of filling machines is positioned along the annular track. In this manner the capacity of this device can be drastically increased by efficient utilization of the length of the provided annular track.

In addition, it is advantageous when the annular track has a plurality of siding segments so that the blister pack to be filled in one filling machine can be parked on its shuttle there without blocking the annular track with shuttles to be filled in the other filling machines. For quality assurance, a third control system is provided, preferably a light curtain for checking the position from which the small objects are dispensed by the picker system into the blister. In addition the shuttle has a memory unit and a unit for bidirectional data traffic so that the data for the blister pack transported by the shuttle can be transmitted directly and individually from the shuttle to the appropriate units or components of the filling machine.

A fourth control system for checking the filled blister pack to ensure that they are complete and/or have the correct contents further enhances quality control.

In order to prevent errors when filling the filling machine with the different small object types, each prefilled provided supply cassette is provided with a code indicating the small object type so that the filling machine can read this code and know which small object type is provided for the feeder for the picker system.

It is furthermore advantageous when a sealing slide for releasing the small objects is allocated to each supply cassette because this makes it easier to exchange the supply cassette in the filling machine, but also because intentionally sliding the sealing slide when a supply cassette is inserted into the filling machine makes it possible to output from the supply cassette only the small objects that are to be picked up subsequently by the picker system. In order to enable reliable operation by the latter with small objects being picked up reliably, the picker system has suction pickers that can be exchanged by means of an exchange system and that are mounted on a suction arm so that the format of the small objects is accounted for.

Another very particularly preferred embodiment of the invention is characterized in that allocated to it is a blister pack machine for producing the blister pack that are to be individually filled and/or a sealing station and/or a punch station for sealing and separating the filled blister pack.

BRIEF DESCRIPTION OF THE DRAWING

The above and other objects, features, and advantages will becom1e more readily apparent from the following description, reference being made to the accompanying drawing in which.

SPECIFIC DESCRIPTION

Figure 2:
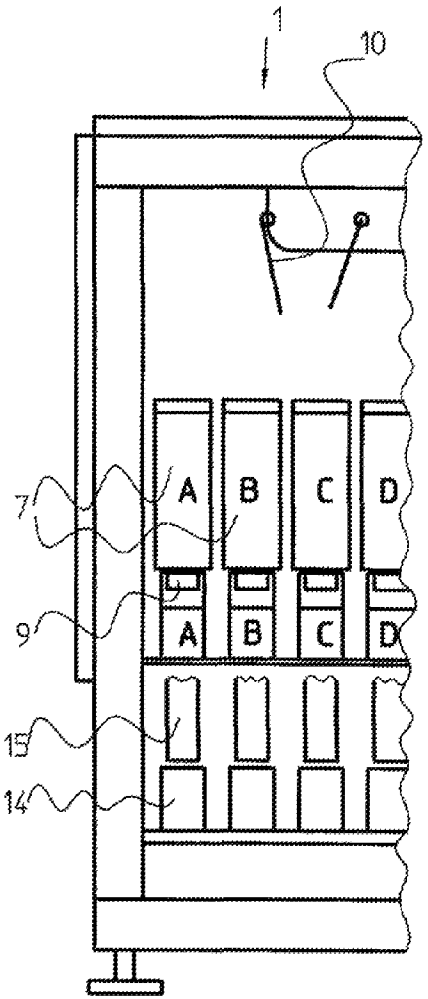
FIG. 2 is a partial end view taken in the direction of arrow II of FIG. 1.
Figure 1:
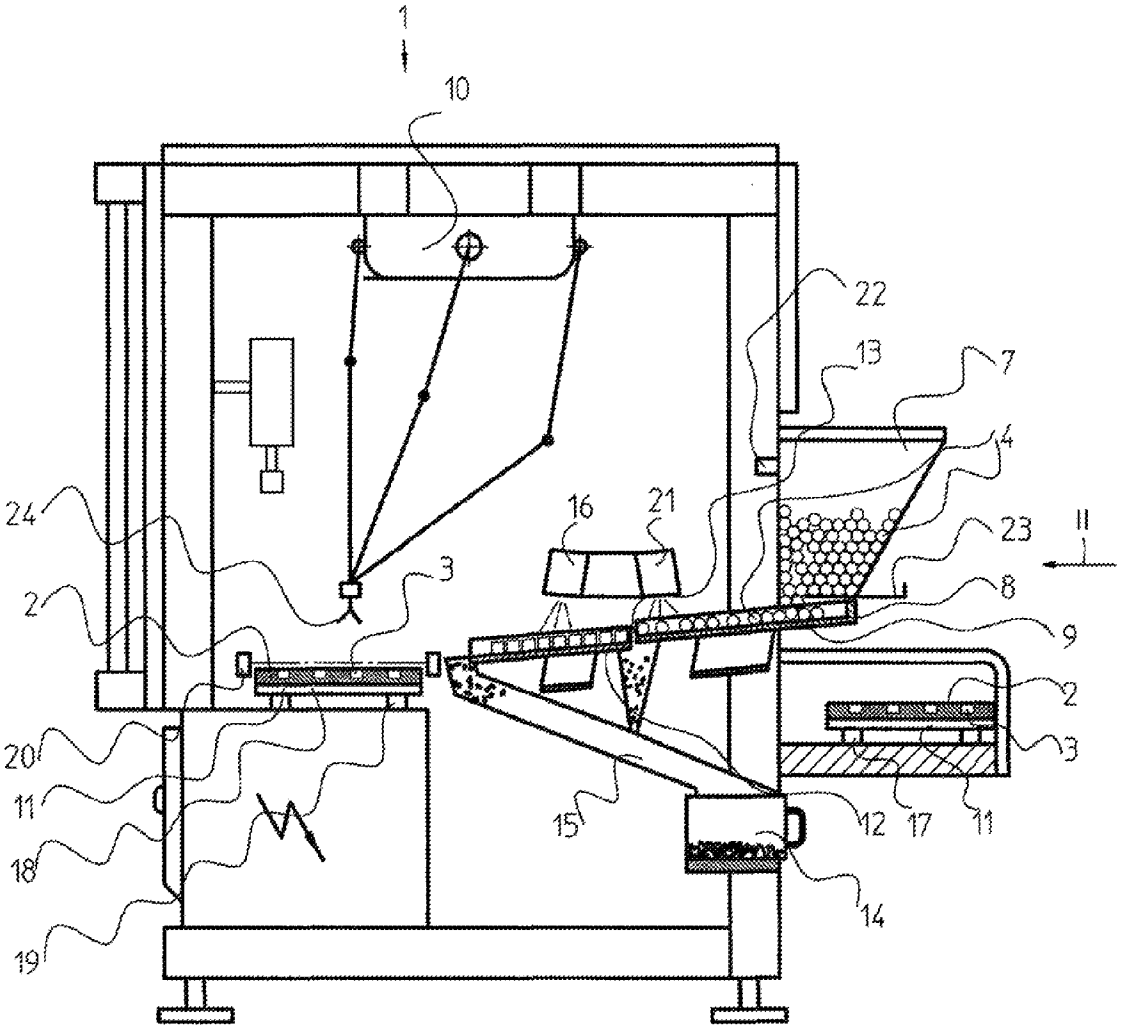
FIG. 1 is a partly schematic front view of a blister-filling apparatus according to the invention.
Figure 4B:
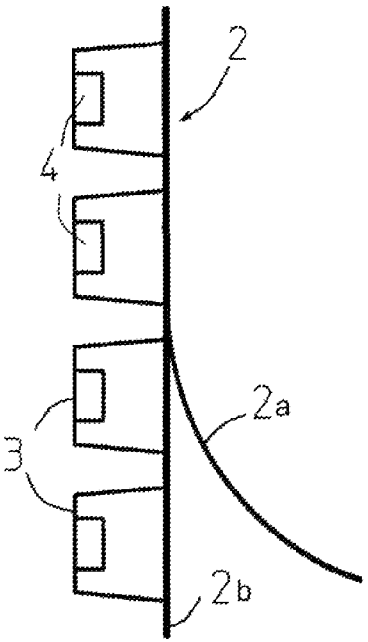
FIGS. 4A and 4B are top and end views of a package made according to the invention.
Figure 4A:
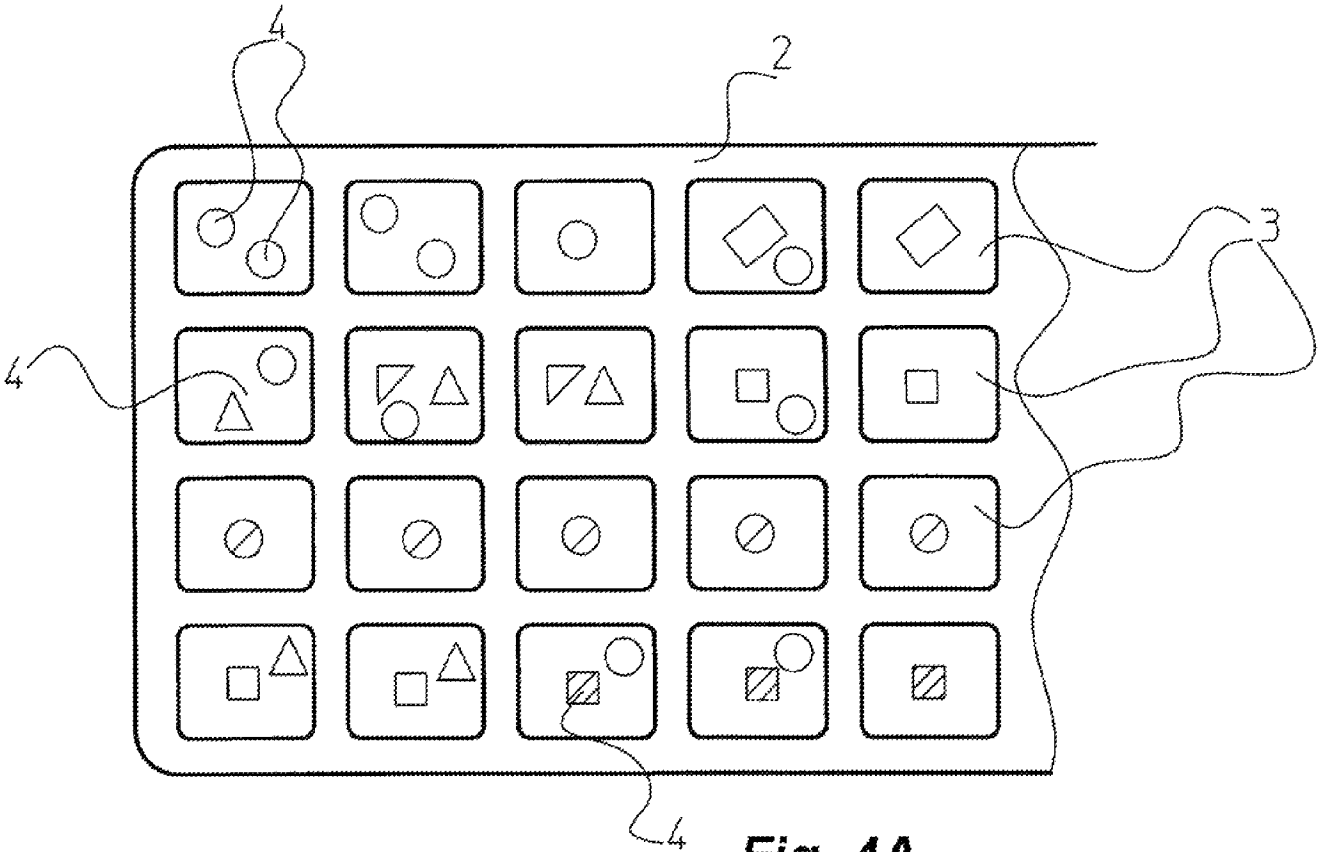
Figure 4C:
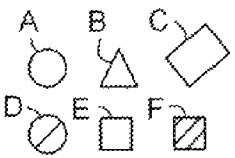
FIG. 4C is a key illustrating the filling of the pack of FIG. 4A.

As seen in FIGS. 1 and 2 a filling machine 1 is used for individually filling blister packs 2 that have at least one pocket 3, a blister pack 2 having a 4×5 matrix of the pockets 3 being shown in the embodiment in the drawing. These pockets 3 can be filled individually, using the filling machine 1, with small objects 4 from a supply of at least two different object types A, B, C, D, E, and F (see FIGS. 4B and 4C), to which end a number of supply cassettes 7 equal to the number of small object types A-F is provided on the filling machine 1. The small objects 4 are moved from outputs 8 of the cassettes 7 by respective feeders 9, and a picker system 10 transfers them into the pockets 3 of the blister pack 2 that can be transported on an annular conveyor system 11 into the filling machine 1 and out of the filling machine 1.

In the embodiment shown in the drawing, the feeder 9 is formed by a vibrating trough 12, it also being possible, however, to use a conveyor belt, grooved belt, or the like for the feeder 9. The feeder 9 is provided in two parts arranged one after the other in the object-transport direction, with the downstream part of the feeder able to convey the small objects 4 such that they are separated and it is easier for the picker system 10 to pick them up. The two parts of the feeder 9 are separated by a gap 13, from below which extends a chute 15 to a waste collector 14.

A plurality of picking systems 10 can be provided in each filling machine 1 in order to be able, as dictated by their range, to reach a corresponding number of supply cassettes 7 with their allocated feeders 9. Moreover, each feeder 9 has a second control system with a camera system 16 for locating the small objects 4 and/or for checking their integrity and/or their composition by means of an NIR (near infrared) system 21 as a first control system, means for exchanging data between the camera system 16 or the NIR system 21 and the feeder 9 and/or the picker system 10 being provided.

Figure 5:
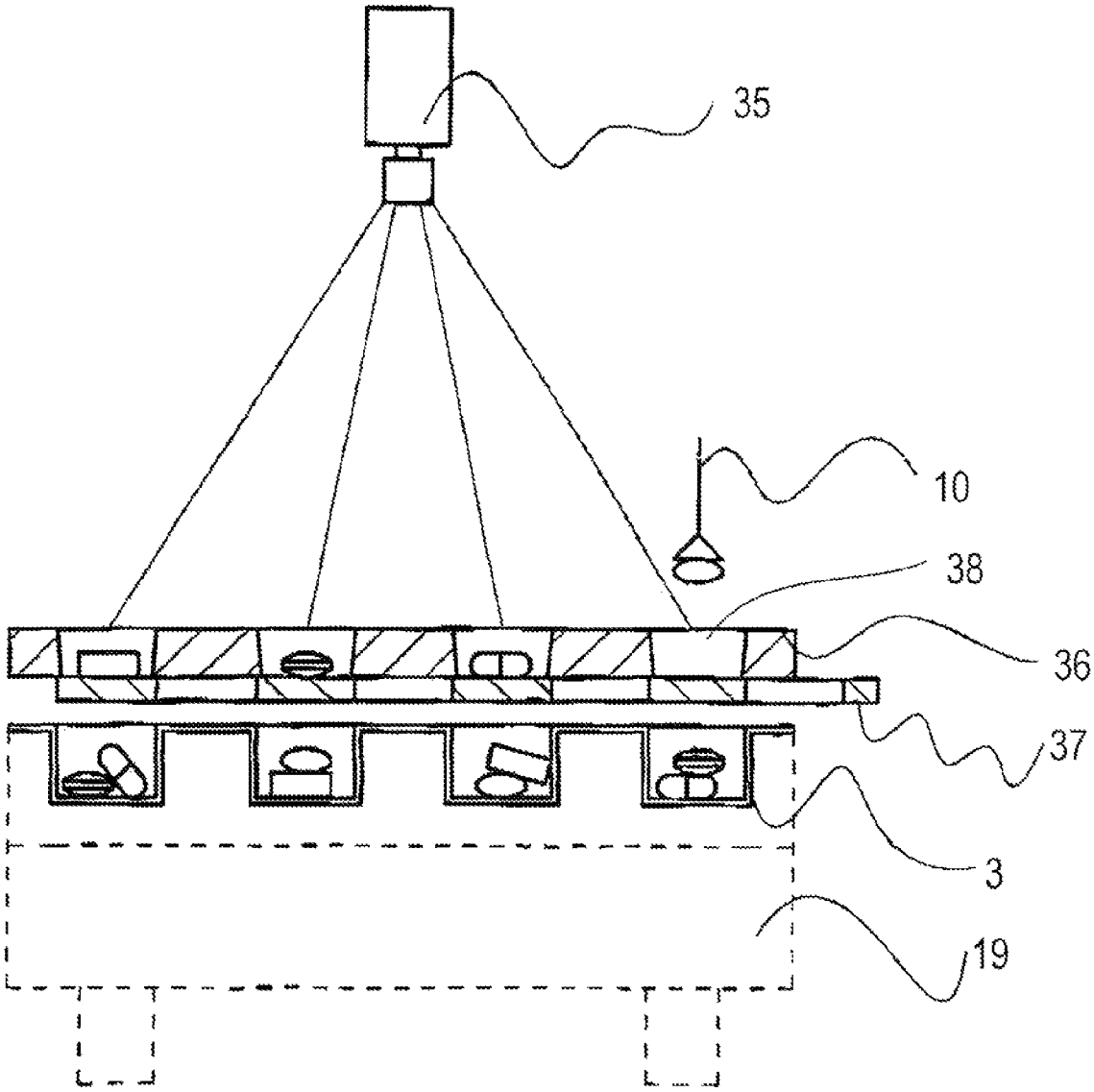
FIG. 5 is a detail view of a variant on the system of this invention.

FIG. 5 also shows a second camera 35 that scans the objects 4 as they are dropped into pockets of a feed plate 36, which pockets are aligned with the blisters 3 of the underlying package. A slider 37 formed with a complementary array of holes 38 is shiftable under the apertured feed plate 36 between a position downwardly closing each of the respective holes 38 and a position freeing the holes 38 so objects can drop therefrom into the blisters 3 underneath. This is done in a four-step process comprised of:

1. Filling the holes 38 with one article 4 per hole 38.
2. Checking with the camera 35 that 11 holes 38 that are supposed to be filled are actually filled.
3. If they are all full, shifting the slide plate 37 to drop the objects 4 into the blisters, otherwise filling the holes 38 that should be filled and repeating step 2 then 3.
4. Checking with the camera 35 that the holes 38 are empty.

Figure 3:
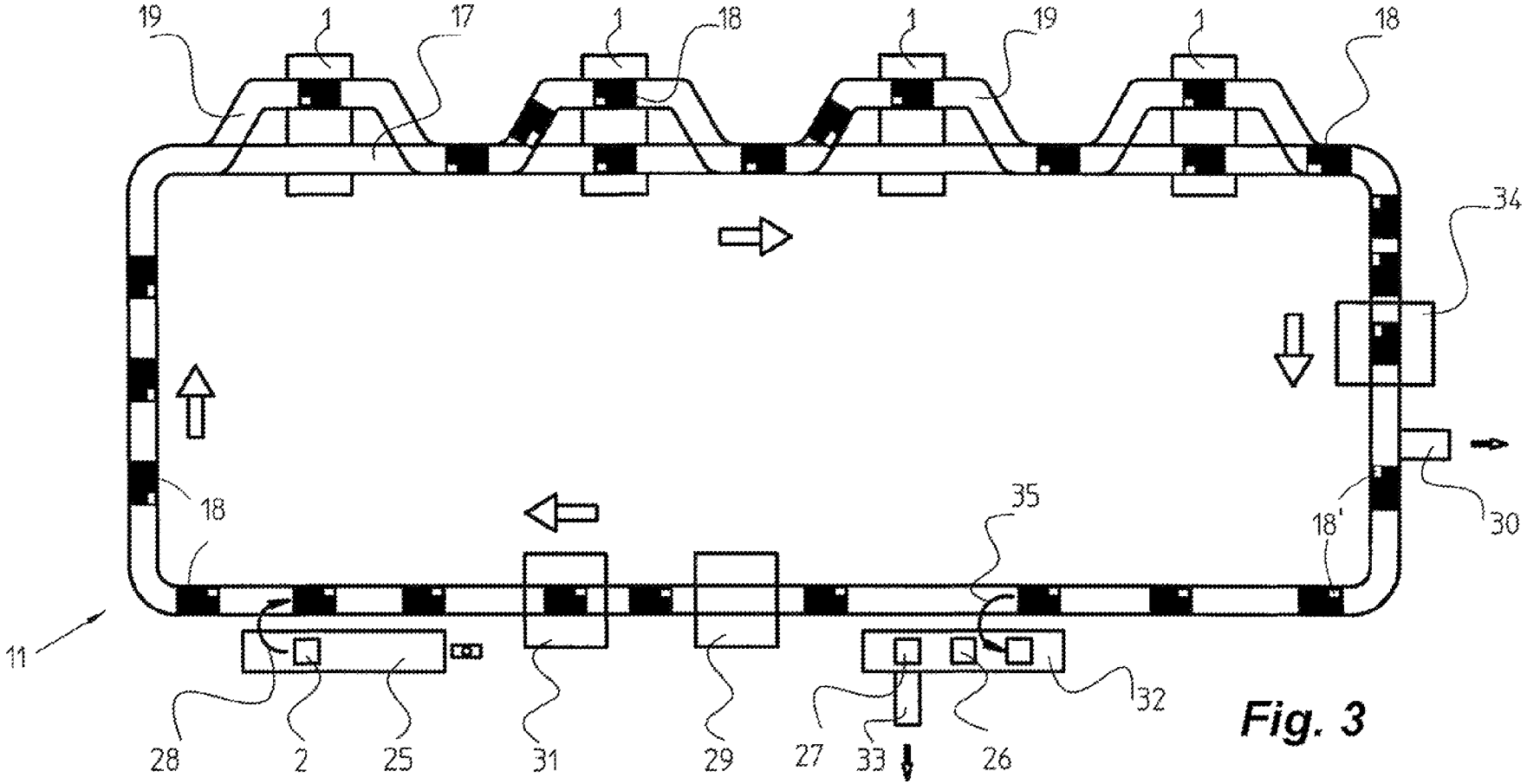
FIG. 3 is a schematic illustration of the annular small object-path in accordance with the invention.

FIG. 3 shows the conveyor system 11 that has a closed annular track 17 on which at least one, but as a rule a plurality of shuttles 18 run in an annular path, each shuttle 18 carrying a respective blister pack 2. In the embodiment shown in the drawing, this annular track 17 extends past a plurality of filling machines 1, here four of them, with a siding portion 19 extending through each machine 1. This way the annular track 17 is not blocked by a shuttle 18 that has stopped in the filling machine 1 for filling.

A third quality-control system 20, specifically a light curtain, checks that the small objects 4 deposited by the picker system 10 into the blister pack 2 are down in and not projecting up out of or lying on the pack 2 between the pockets 3.

Each shuttle 18 has a programmable memory unit 18' that can emit and receive data so it can tell the picker system 10 which small objects 4 of a given small object type are to be placed into which of its pockets 3. The first control system 21 is provided for checking the filled blister pack 3 to ensure that they are complete and/or that their content is correct.

Each supply cassette 7 has a code 22 indicating the type of respective small object 4 and has a sealing slide 23.

According to embodiments not shown in the drawing, the picker system 10 has suction pickers 24 that can be exchanged automatically by means of an exchange system and that are mounted on a suction arm; in addition, a blister pack machine 25 for producing the blister pack 2 to be individually filled and/or a sealing station 26 and a second blister pack machine 32 having a punch station 27 for sealing and for punching the edge of the filled blister pack 2 can be allocated to the annular track 17.

With such an apparatus it is possible to individually fill blister packs 2 each having at least one pocket 3 with small objects 4 from a selection of at least two different small object types, to which end the separate supply cassettes 7 provided with the required small object types are initially loaded onto the filling machine 1. Moreover, the blister pack 2 that is positioned in a loading station 28 on the shuttle 18, in the memory unit 18' of which the data required for the individual filling are loaded using a data transfer device 31, is then caused to circulate on the annular track 17 to a siding 19 into the filling machine, the data being transmitted from the shuttle 18 to the respective picker system 10, and where necessary to the camera system 16 and the NIR system 21 and the light curtain 20, that is, to the control systems in general, and to the feeder 9 using data exchange, which then picks up the required small objects 4 from the feeders 9 of the supply cassettes 7 and sets them in the required pockets 3. The blister pack 2 thus individually filled and checked using the third control system 20 is then moved out of the filling machine 1 and checked by the first control system 21, finished blister packs being removed in a first unloading station 33. Downstream of this first unloading station 33, an erasing module 29 for the shuttle memory 18' is allocated to the annular track 17 so that once the shuttle 18 has been cleaned it can be reprogrammed with the data for the next blister pack 2 to be filled, which is then positioned in the loading station 31 on the shuttle 18 for circulation and filling with the necessary pills or the like. Defective blister packs 2 that are detected by means of a fourth control system 34 are culled out at a second unloading station 30.

We claim:

1. A method of filling blister packs each having a plurality of pockets with individualized assortments of small objects, the method comprising the steps of:

fitting to each of a plurality of shuttles a respective blister pack;

circulating the shuttles around an annular track through a plurality of filling machines each having a plurality of supplies each holding a bulk quantity of small objects of a respective type, respective feeders each receiving the objects of a respective supply and advancing same to a respective picking location, and respective pickers;

programming a memory of each shuttle with data regarding the intended contents of the pockets of the respective blister pack;

in each of the machines, reading the memories of the shuttles as they pass through the respective filling machine, stopping each of the shuttles with the respective blister pack in the filling machine, and operating the respective pickers to pick, lift, and move the small objects from the feeders to the pockets of the stopped blister packs in accordance with the data for the respective blister pack; and removing blister packs from the shuttles downstream of the filling machines and erasing the respective memories.

2. The filling method defined in claim 1 wherein the track subdivides at each machine into a siding segment that passes through the respective machine and a bypass segment that does not, the method comprising the step of moving shuttles along the bypass segments past filling stations in which blister packs on shuttles are being filled.

3. The filling method defined in claim 1, further comprising the step in each of the filling machines of verifying that the objects in the pockets of a blister pack correspond to the data in the respective memory and at a culling station triggering culling of the pack when the contents of the respective pockets are incorrect.

4. A method of filling blister packs each having a plurality of pockets with individualized assortments of small objects, the method comprising the steps of:

fitting to each of a plurality of shuttles a respective blister pack;

circulating the shuttles around an annular track through a plurality of filling machines each having a plurality of supplies each holding a bulk quantity of small objects of a respective type, respective feeders each receiving the objects of a respective supply and advancing same to a respective picking location, and respective pickers;

programming a memory of each shuttle with data regarding the intended contents of the pockets of the respective blister pack; and in each of the machines, reading the memories of the shuttles as they pass through the respective filling machine and operating the respective pickers to pick, lift, and move the small objects from the feeders to the pockets in accordance with the data for the respective blister pack;

verifying in each of the filling machines that the objects in the pockets of a blister pack correspond to the data in the respective memory and at a culling station triggering culling of the pack when the contents of the respective pockets are incorrect; and supplying a shuttle from which a pack has been culled with a fresh pack and then recirculating it through the filling machines without changing the data in the respective memory.

* * * * *